US008740310B2

(12) United States Patent
Refsdal et al.

(10) Patent No.: US 8,740,310 B2
(45) Date of Patent: Jun. 3, 2014

(54) MINING METHOD FOR CO-EXTRACTION OF NON-COMBUSTIBLE ORE AND MINE METHANE

(75) Inventors: Larry Refsdal, Green River, WY (US); Ronald O. Hughes, Green River, WY (US); Bryan M. Mortimer, Green River, WY (US); Richard A. Hodgson, The Woodlands, TX (US); Joseph A. Vendetti, Green River, WY (US)

(73) Assignee: Solvay Chemicals, Inc., Houston, TX (US)

( * ) Notice: Subject to any disclaimer, the term of this patent is extended or adjusted under 35 U.S.C. 154(b) by 452 days.

(21) Appl. No.: 12/487,802

(22) Filed: Jun. 19, 2009

(65) Prior Publication Data

US 2009/0315388 A1 Dec. 24, 2009

Related U.S. Application Data

(60) Provisional application No. 61/074,317, filed on Jun. 20, 2008, provisional application No. 61/085,735, filed on Aug. 1, 2008.

(51) Int. Cl.
*E21F 7/00* (2006.01)

(52) U.S. Cl.
USPC ..... 299/12

(58) Field of Classification Search
USPC ..... 299/12
See application file for complete search history.

(56) References Cited

U.S. PATENT DOCUMENTS

| | | | | | |
|---|---|---|---|---|---|
| 3,479,133 | A | * | 11/1969 | Warzel | 423/184 |
| 3,479,134 | A | * | 11/1969 | Warzel | 423/427 |
| 3,778,108 | A | * | 12/1973 | Pennington et al. | 299/11 |
| 3,934,649 | A | | 1/1976 | Pasini, III et al. | |
| 4,017,121 | A | | 4/1977 | Trent | |
| 4,305,464 | A | | 12/1981 | Masszi | |
| 4,978,172 | A | * | 12/1990 | Schwoebel et al. | 299/12 |
| 5,246,273 | A | * | 9/1993 | Rosar | 299/4 |
| 6,357,523 | B1 | | 3/2002 | Zupanick | |
| 6,604,580 | B2 | | 8/2003 | Zupanick et al. | |
| 6,679,322 | B1 | | 1/2004 | Zupanick | |
| 6,688,388 | B2 | | 2/2004 | Zupanick | |
| 2007/0231233 | A1 | * | 10/2007 | Bose | 423/245.1 |
| 2008/0121399 | A1 | | 5/2008 | Zupanick | |

* cited by examiner

*Primary Examiner* — John Kreck
(74) *Attorney, Agent, or Firm* — Beatrice C. Ortego

(57) ABSTRACT

A method for co-extracting non-combustible ore (e.g., trona) and methane from an underground formation comprising at least one methane-bearing layer and a non-combustible ore bed having a rock roof, comprising:

providing a well having a downhole end positioned above the ore bed roof;

mining an ore region from an initial cavity and removing the mined ore, thereby creating a subsequent cavity;

advancing the mining step to another ore region from the subsequent cavity;

allowing the roof of the initial cavity to cave so as to create a gob;

repeating the mining, advancing and caving steps, the caving being effective in generating fluid communication between the gob and the well downhole end and in fracturing the methane-bearing layer so as to release methane into the gob; and recovering a gob gas comprising released methane through the well to the surface.

21 Claims, 6 Drawing Sheets

MINING METHOD FOR CO-EXTRACTION OF NON-COMBUSTIBLE ORE AND MINE METHANE

CROSS-REFERENCE TO RELATED APPLICATIONS

This application claims the priority benefit under 35 U.S.C. §119(e) to U.S. provisional application No. 61/074,317, filed on Jun. 20, 2008 and to U.S. provisional application No. 61/085,735, filed on Aug. 1, 2008, each of these applications being incorporated herein by reference in its entirety for all purposes.

FIELD OF THE INVENTION

The invention relates to a method for recovering mine methane produced during the mining of non-combustible ore, such as trona. The invention relates to a mining method for co-extraction of trona and methane.

BACKGROUND OF THE INVENTION

Mine methane is defined as a gas of predominately methane ($CH_4$) with lower concentrations of non-methane hydrocarbons, nitrogen, ammonia, carbon dioxide, and other trace gases. Mine methane is released into the mine atmosphere during the mining of trona.

Trona ore is a mineral that contains about 90-95% sodium sesquicarbonate ($Na_2CO_3.NaHCO_3.2H_2O$). A vast deposit of the mineral trona is found in southwestern Wyoming near Green River. This deposit includes layers of trona and mixed trona and halite (rock salt or NaCl) which covers approximately 2,600 $km^2$. The major trona beds range in size from less than 428 $km^2$ to at least 1,870 $km^2$. By conservative estimates, these major trona beds contain about 75 billion metric tons of ore. The different beds overlap each other and are separated by layers of shale and marlstone. The quality of the trona varies depending on its particular location in the stratum.

A typical analysis of the trona ore mined in Green River is as follows:

TABLE 1

| Constituent | Weight Percent |
|---|---|
| $Na_2CO_3$ | 43.2 |
| $NaHCO_3$ | 33.7 |
| $H_2O$ (crystalline and free moisture) | 15.6 |
| NaCl | 0.1 |
| Insolubles | 7.3 |

The sodium sesquicarbonate found in trona ore is a complex salt that is soluble in water. The mined trona ore is processed generally in a surface refinery to remove the insoluble material, organic matter and other impurities to recover the valuable alkali contained in the trona.

The most valuable alkali produced from trona is sodium carbonate. Sodium carbonate is one of the largest volume alkaline commodities produced in the United States. In 2007, trona-based sodium carbonate from Wyoming comprised about 91% of total U.S. soda ash production. Sodium carbonate finds major use in the glass-making industry and for the production of baking soda, detergents and paper products.

The trona deposits found in Southwestern Wyoming are formed in multiple beds in the Wilkins Peak Member of the Eocene Green River Formation at depths ranging from 240 to 910 meters (800-3000 feet). The Wyoming trona deposits are evaporites that form substantially horizontal beds. The beds vary greatly in thickness, from about 0.3 meter to about 5 meters (about 1-16 feet). An underground formation comprising a trona bed generally further comprises a methane-bearing layer. Interbedded with trona beds are layers of methane-bearing oil shales. For example, layers of mainly weak, laminated green-grey shales and oil shale may be above a trona bed. Immediately below the trona bed may lie substantially horizontal layers of somewhat plastic oil shale. Both overlying and underlying shale layers can liberate methane during mining. It is also possible for marlstone layers to liberate entrapped methane upon fracture. The trona itself contains very little carbonaceous material and therefore liberates very little methane. According to a first known mining technique, called the room-and-pillar technique, a number of rooms are created in the underground formation, connected by an array of tunnels. Between the rooms, a series of trona pillars are left in place to support the roof of the mine rooms. The disadvantage of this technique is that the trona contained in the pillars is not mined, resulting in a loss of valuable mineral.

According to another mining technique, called the solution mining technique, the mineral is recovered by introducing a fluid from the earth's surface to dissolve the trona deposit. The solution, when enriched in dissolved trona is pumped out of the formation and treated in a surface refinery. The solution mining can create a mined-out cavity within the trona ore. From the weight of the overburden, caving of overlying trona and rock may occur, which could result in strata subsidence and fracture of underlying and/or overlying oil shales, thus liberating mine methane into the caved-in area.

According to a third well known mining technique, called the "long-wall" mining technique, the roof is supported by movable hydraulic supports as the trona is mined. After mining the trona, the supports are advanced, allowing the unsupported roof to collapse. The caved-in area comprising fallen broken rock may be referred to as "gob". The gob formation is generally accompanied by fracture of overlying and/or underlying oil shale layers.

When utilizing a mining technique for trona which results in fracturing one or more oil shales, a significant amount of methane can be liberated from the fractured oil shale(s). This released methane can mix with the mine air, and in such event, the released methane must be diluted to safe levels in the return airways of the mine's ventilation system in order to then be exhausted to the atmosphere. The method of diluting the methane using the mine ventilation system requires that the methane concentration be diluted with air from a high level to a low level. Through dilution, the methane content passes through the explosive range of methane-air mixture (5%-15% methane in air) during the process. This passage through the explosive range causes a safety risk, and thus to avoid hazardous methane contents in mine working places and return airways, a large volume of dilution air is required. If additional methane is released, additional air for dilution is necessary. Additionally, regulations require a maximum allowable methane content in the return airways, which is generally less than 1%. The additional air requirement increases ventilation pressure which results in increased air leakage through ventilation structures and increased energy consumption.

Although these foregoing issues have been described in terms of trona mining, they also apply to any mine in which a non-combustible ore is extracted and which is capable of liberating methane during the mining of the non-combustible ore.

SUMMARY OF THE INVENTION

One aspect of this invention is the recovery of mine methane produced as the result of mining a non-combustible ore, such as trona. The recovery of mine methane, via a system other than the mine ventilation system, provides a safer working environment underground, and/or provides recovery of a valuable energy source, as the recovered mine methane is much less diluted with mine air than the return ventilation exhaust. At least a part of this energy source can be used in the surface refinery which produces a desired mineral from the mined non-combustible ore, such as producing soda ash from mined trona.

Consequently, the invention relates to a mining method for co-extraction of non-combustible ore and mine methane from an underground formation which comprises a non-combustible ore bed to be mined and at least one methane-bearing layer, the ore bed having a roof above which rock material is present. The mining method comprises:

- drilling a least one well from the earth's surface towards the ore bed, said well having a downhole end positioned above the ore bed roof, said downhole end of the well not being in contact with the ore bed to be mined;
- providing at least an initial cavity into the formation, the initial cavity giving access to an initial working face of the ore bed to be mined;
- mining an ore region from the initial working face and removing the mined ore, thereby creating a subsequent mined-out cavity with a new subsequent working face;
- advancing the mining step to another ore region from the subsequent working face;
- allowing the roof of the initial cavity to cave so as to create a gob containing at least rock rubbles;
- repeating the mining, advancing and caving steps, in a manner effective to cause fracture of the methane-bearing layer and release of mine methane into the gob, and to further establish fluid communication between the gob and the downhole end of the well; and
- recovering a gob gas comprising the released methane through the well to the surface.

The present invention further relates to a method for reducing the greenhouse effect during mining of a non-combustible ore with co-production of mine methane from an underground formation, said method comprising carrying out the mining method as previously described, wherein the underground formation comprises at least one methane-bearing layer and a non-combustible ore bed comprising or consisting of trona, and wherein at least a portion of the mine methane is recovered via a gob well and combusted.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions or methods do not depart from the spirit and scope of the invention as set forth in the appended claims.

BRIEF DESCRIPTION OF THE DRAWINGS

For a detailed description of the preferred embodiments of the invention, reference will now be made to the accompanying drawings which are provided for example and not limitation, in which.

On the figures, identical numbers correspond to similar references.

DETAILED DESCRIPTION OF THE INVENTION

Figure 1:
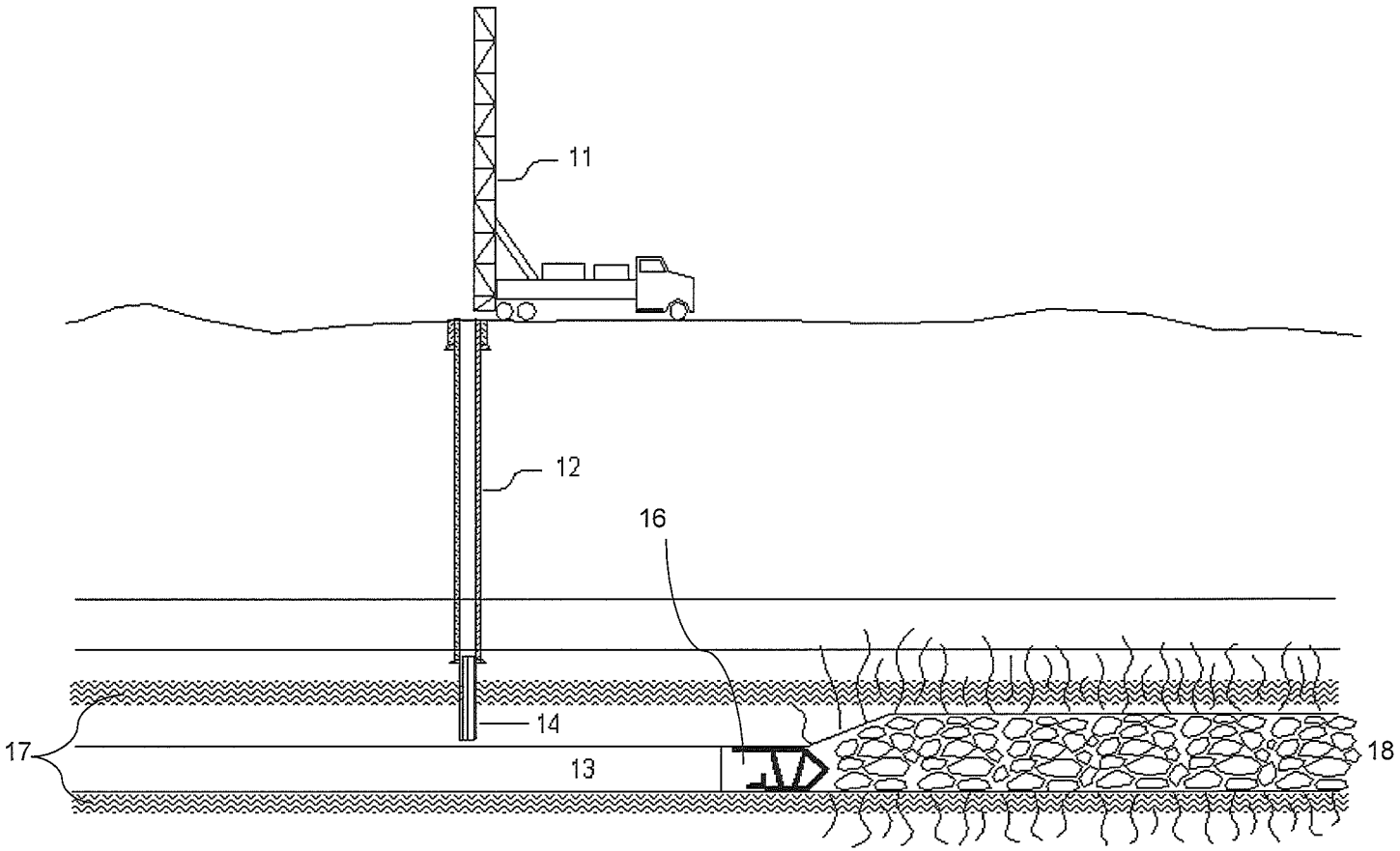
FIG. 1 illustrates an elevation view of a trona mining system and its mining operation for extracting trona from a formation according to a first embodiment of the present invention, wherein the mining method comprises the drilling of a gob vent well with a rubber-tired mounted drill rig, such gob vent well being positioned above a trona bed and crossing through at least one methane-bearing layer.

A mining method according to the invention can extract non-combustible ore and mine methane from an underground formation which comprises a non-combustible ore bed to be mined and at least one methane-bearing layer, the ore bed having a roof above which rock material is present. Such method is particularly useful for the mining of trona.

It should be understood that any following or foregoing embodiment which is described in terms of trona mining is equally applicable to the mining of non-combustible ore, unless otherwise stated.

In the mining method according to the invention, a well is drilled from the earth's surface in a downward manner toward the ore bed to be mined. However the well does not come in contact with the ore bed to be mined, that is to say, the well does not reach or intersect the roof of the non-combustible ore bed to be mined. The subterranean location of the downhole end of the well should be above the roof of the ore bed so that the the downhole end of the well is not in contact with non-combustible ore. The well may comprise a vertical portion. The well (or a portion thereof) may be slanted with respect to the axial centerline of the ore bed to be mined. It is preferred that the well be substantially vertical. The term 'substantially' is used for well positioning, as it is meant to include some variation (within 10%) of the actual direction of the well. Indeed, even though spatial determination for drilling can be quite accurate, it is expected than spatial variation may occur, and as such, a variance up to 10 degrees or less in the alignment of some portions of the well may be expected. It is thus preferred that the main longitudinal axis of the well be vertical.

It is preferred that the well may be drilled from a surface location offset from the axial centerline of a trona panel in the case of long-wall mining of trona.

It is envisioned that the well may comprise a downhole end which may have a different longitudinal axis than the main longitudinal axis of the well. For example the downhole end may be slanted or perpendicular with respect to the main longitudinal axis of the well, and/or may be slanted or parallel with respect to the axial centerline of the ore bed to be mined. It is preferred that the longitudinal axis of the downhole end of the well be vertical.

It is also envisioned that a tubular casing be placed in the well, at least in its upper part, after its drilling to ensure smooth flow of the gob gas, and that the well downhole end may comprise a slotted casing. It is advantageous that the slotted casing of the well downhole end be moveable. The slotted casing should not be fixed to the casing of the upper part of the well and should be positioned free-standing at the bottom of the well in a flexible way to allow relative movement of the slotted casing with respect to the well upper part.

The ore bed to be mined may comprise any suitable non-combustible ore containing a desirable mineral. The non-combustible ore preferably is essentially free (not more than 5%) of coal, crude oil, tar, oil shale, or any mixtures thereof, or more preferably does not contain coal, crude oil, tar, or any mixtures thereof. The non-combustible ore preferably is essentially free of (entrapped and/or adsorbed) gaseous hydrocarbons, e.g., not more than 1% of $C_1$-$C_5$ hydrocarbons. The non-combustible ore is generally a layer made of one or more inorganic compounds.

The non-combustible ore bed preferably contains a desired mineral or a precursor thereof which can be obtained by processing the mined ore in a surface refinery. In preferred embodiments, the ore bed to be mined may comprise an evaporite mineral. A suitable evaporite mineral may comprise an element selected from the group consisting of halite, carbonate, sesquicarbonate, bicarbonate, nitrate, iodate, borate, sulfate, and phosphate. In some embodiments, the evaporite mineral may be selected from the group consisting of trona, nahcolite, Wegscheiderite, halite, potash, langbeinite, sylvite, and carnalite. In preferred embodiments, the non-combustible ore bed to be mined comprises at least one evaporite mineral selected from the group consisting of trona, nahcolite, and Wegscheiderite. The ore bed preferably contains a desired sodium mineral or a precursor thereof which is selected from the group consisting of sodium sesquicarbonate, sodium bicarbonate, and sodium carbonate.

In yet more preferred embodiments, the non-combustible ore bed comprises trona or any evaporite deposit containing sodium sesquicarbonate, carbonate and/or bicarbonate, or even more preferably consists of a trona bed (also called 'trona seam').

A trona bed or seam may have a thickness of from 5 feet to 30 feet (1.5-9.1 m), or may be thinner with a thickness from 1.5 to 6 meters (from about 5 to 15 feet), and may be located at a depth of from 244 to 910 meters (from about 800 to 3000 feet) below the surface. A trona bed is generally higher in compressive strength than the overlying and underlying strata.

In alternate embodiments, the non-combustible ore bed contains potash.

A mining method according to the present invention extracts non-combustible ore and mine methane from an underground (subterranean) formation comprising at least one methane-bearing layer and a non-combustible ore bed to be mined having a roof above which rock material is present. Such method comprises:

- drilling a least one well from the earth's surface towards the ore bed, said well having a downhole end positioned above the ore bed roof, said downhole end of the well not being in contact with the ore bed to be mined;
- providing at least a first (initial) mined-out cavity into the underground formation, the first cavity giving access to a first (initial) working face of the ore bed to be mined;
- mining a region of the ore from the first (initial) working face;
- removing the mined ore, thereby creating a second (subsequent) mined-out cavity with a second (subsequent) working face;
- advancing the mining step to another ore region from the second (subsequent) working face;
- allowing the top of the first (initial) mined-out cavity to cave so as to create a gob containing rock rubbles; and
- repeating the mining, advancing and caving steps in a maimer effective to enlarge the volume of the gob while reducing the volume of ore to be mined.

The caving step is also effective in causing the release of mine methane into the gob from at least one fractured methane-bearing layer. The caving step should also be effective in ultimately establishing fluid communication between the gob and the downhole end of the well.

The method further comprises recovering a gob gas comprising at least a portion of the released methane that passes from the gob through the well to the surface. The recovered gob gas may comprise at least 25% methane.

The underground formation which comprises the non-combustible ore bed to be mined having a roof and a floor may have at least one overlying methane-bearing layer above the ore bed roof and/or may have at least one underlying methane-bearing layer below the ore bed floor. Generally, the overlying and/or underlying methane-bearing layer is distinct from the non-combustible ore bed. The methane-bearing layer may be an oil shale layer. In the example of trona mining, interbedded with trona deposits may be layers of green to gray shales, marlstones, and oil shale. In the case of trona Bed 17 near Green River, Wyo., oil shale layers occur both above and below the trona bed, and methane is liberated from these oil shale layers during mining. Indeed, when mining of trona causes part of the trona roof to cave and form a gob with fallen rock rubbles, a significant amount of mine methane may be released due to (1) the caving action of the mining system which results in the fragmentation of the immediate mine roof and fracturing of at least one overlying methane-bearing layer positioned above the trona bed roof, and/or (2) the release of pressure on strata below the floor of the trona bed which allows methane to rise from of at least one fractured underlying methane-bearing layer into the mined-out cavity left by mining. This released mine methane can collect in the gob (caved portion) at high levels.

The downhole end of the well preferably is not in fluid communication with the ore layer to be mined, and preferably is located at a distance above the ore roof. Such distance however should be close enough to the ore roof such that after gob formation, there is a creation of fluid communication between the gob and the downhole end of the well. The distance between the well downhole end and the ore roof may be at least 3 meters, more preferably at least 5 meters. It is advantageous that the downhole end of the well does not come in contact with the ore which is to be mined or is being mined.

When the underground formation has an overlying methane-bearing layer above the non-combustible ore bed, the downhole end of the well is preferably substantially in fluid communication with at least a part of the overlying methane-bearing layer. By 'substantially in fluid communication' is meant that after gob formation, the methane released by the overlying methane-bearing layer and circulating in the gob can be recovered through the well. It is advantageous that the downhole part of the well reaches an overlying methane-bearing layer and even passes through it. In preferred embodiments, the downhole end of the well is positioned at an intermediate depth between the overlying methane-bearing layer and the roof of the ore to be mined or being mined.

When the underground formation bed has an underlying methane-bearing layer, the downhole end of the well is not in fluid communication with the underlying methane-bearing layer. After gob formation, the methane released by the underlying methane-bearing layer moves upwards into the gob and can be recovered through the well to the surface.

The first (or initial) cavity is preferably a mined-out cavity provided by at least one underground mining technique selected from the group consisting of longwall mining, short-wall mining, room-and-pillar mining, and solution mining. Solution mining is an ore extraction process by which a mineral is extracted from an underground formation by injecting a solvent (usually water or an aqueous solution) into the mineral-containing ore body. The solvent dissolves the mineral which causes the density of the resulting solution to increase. The denser, mineral-enriched solution then sinks to the base of the ore bed where an extraction well pumps the mineral-saturated brine (or liquor) to the surface for processing. Solution mining does not require miners or heavy mining machinery to be underground. Long-wall mining, short-wall mining, and room-and-pillar mining require miners and heavy machinery to be underground.

According to the invention, at least a part of the unsupported roof of the first (initial) cavity caves to generate the gob. It is desirable that as the mining of the ore advances in subsequent mined-out adjacent cavities and the gob is progressively getting larger, the downhole end of the well becomes surrounded with the gob, thus establishing fluid communication between the gob and the well. In that manner, the methane circulating in the gob is able to migrate upwards towards the downhole end of the well. Since methane has a relative density compared to air of about 0.55, this buoyancy allows methane to move upwards in the gob. This upwards methane movement should minimize the migration of methane towards the working (mining) face of the ore being mined. In this way, a significant portion of the released methane can be vented at the earth's surface by passing through the well. For this reason, this well may be called a "gob vent" well or "gob vent" bore (GVB).

The well could be drilled into a previously formed cavity, such as a previously-formed gob. It is however preferred that the well be drilled before the gob formation, so that methane recovery may begin as soon as it is released by at least one fractured overlying and/or underlying methane-bearing layer. Even though it is preferred for the well to be drilled before mining is initiated underneath its downhole end, there should be no methane release until the rock surrounding the well downhole end begins caving. That is to say, there is no pre-mining release of methane. The mine methane release is only due to the caving of the unsupported roof of a mined-out area, such caving that causes fractures in the methane-bearing layer (s) above the gob or even below the gob, which allow methane to be released. Eventually the caving action also establishes fluid communication between the gob and the well.

The gob gas flow is facilitated by a vacuum pump or an exhauster.

Figure 2:
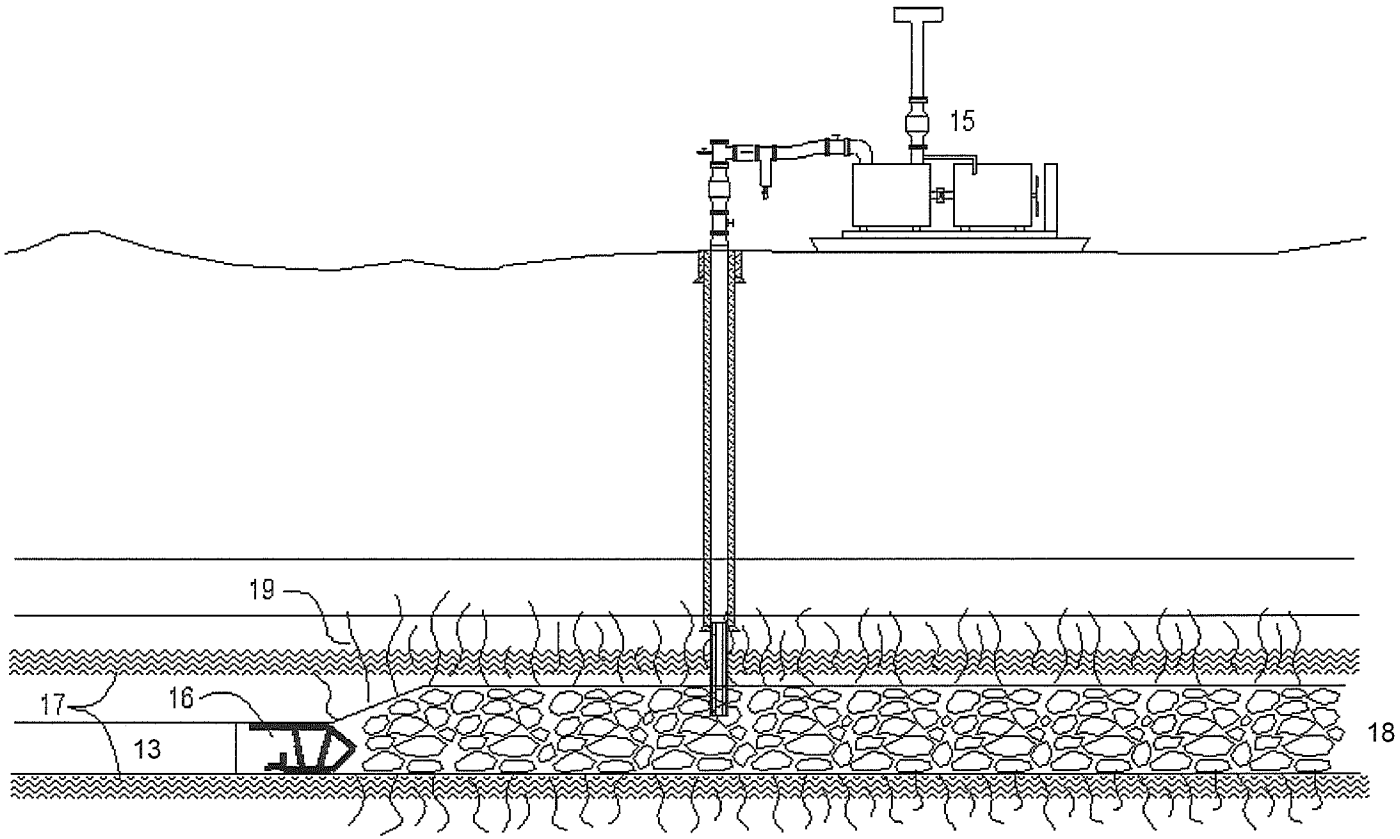
FIG. 2 illustrates an elevation view of a mining system and its operation for extracting trona and producing methane according to a second embodiment of the present invention, wherein a vent well positioned above a trona bed is in fluid communication with the gob, wherein methane released by fracture of at least one methane-bearing layer is collected in the gob, and wherein a gob gas is sent to the surface via a methane-powered pumping system installed at the surface end of the vent well.

In a preferred embodiment of mining of a trona bed as illustrated for example in FIG. 1 and FIG. 2, the depth of the well 12 is such that the downhole end 14 of the well 12 is kept above the roof of the trona bed 13. This ensures that, during the mining of the trona free face, the well 12 is not in communication with the trona mined-out cavity 16. It is recommended that the downhole end of the well 12 be situated at least 3 meters, more preferably at least 5 meters, above the roof of the trona bed 13, in order to have a sufficient thickness of rock separating the downhole end 14 of the well 12 from the ore mined-out cavity 16 whose free face is being mined.

As the long-wall mined-out cavity 16 advances past the downhole end 14 of the well 12 as shown in FIG. 2, the unsupported roof of the mined-out cavity collapses thus creating the gob 18 containing rock rubbles. The caving action also generates fractures 19 in the oil shale layers 17 above the gob 18 and below the bed 13 which liberate mine methane from these layers 17 into the gob 18. In this preferred embodiment, the majority of the mine methane released from fractured oil shale layers 17 can be extracted via the well 12 with the help of a methane-vacuum pump 15 (as shown in FIG. 2). The methane flow towards the trona working face is largely minimized during mining, thus diminishing the potential safety hazards to the mining equipment and miners.

In the mining method according to the present invention, it is recommended that a tubular solid casing be placed in the vent well after its drilling, to ensure smooth flow of the gob gas (containing methane) through that well. The casing is preferably metallic.

In an advantageous embodiment of the present invention, the downhole end of the well comprises a slotted casing. Such slotted casing enables flow of the methane through the slots from the gob into the well. It is advantageous that the slotted casing of the well downhole end is moveable. The slotted casing should not be fixed to the casing of the upper part of the well and should be positioned free-standing at the bottom of the well in a flexible way to allow relative movement of the slotted casing with respect to the well upper part. In such a maimer, the slotted casing can drop down when caving occurs underneath the well downhole end. The slotted casing is long enough to extend at least 6 meters (about 20 feet), with a distance of 12.2 meters (about 40 feet) being typical, into the bottom portion of the solid casing. This overlap is needed when the slotted casing drops some distance due to the post-mining caving. In this embodiment, it is recommended that the downhole slotted casing has a length ranging between 30 and 100 meters.

The method according to the invention reduces the content of methane in the gob (caved area) behind the ore working face. The methane can be vented directly to the surface through the gob vent well.

A methane-powered engine coupled to a vacuum pump or an exhauster is preferably used to exhaust the gob gas containing the released methane directly from the gob. The engine is preferably powered by at least a part of the released mine methane. With the use of the gob vent well and the methane-powered pump which draws a vacuum, the infiltration of the exhausted gob gas into the return airways of the mine ventilation system can be reduced.

The method according to the invention is suitable for one or more different specific mining techniques. Any mining method which results in the caving of the rock overlying the ore bed and fracture of at least one methane-bearing layer (positioned above and/or below the ore bed) or any methane-bearing stratum in proximity to the ore bed lends itself to the recovery of mine methane through the gob vent well or bore. The mining step in such method preferably includes at least one mining technique selected from the group consisting of long-wall mining, short-wall mining, and solution mining.

It should be understood however that the first mined-out (or initial) cavity which is used to initiate the mining step according to the present method, may have been previously mined by the same technique used during the mining step of the present method or by a different technique selected from the group consisting of room-and-pillar mining, long-wall mining, short-wall mining, and solution mining.

Figure 3:
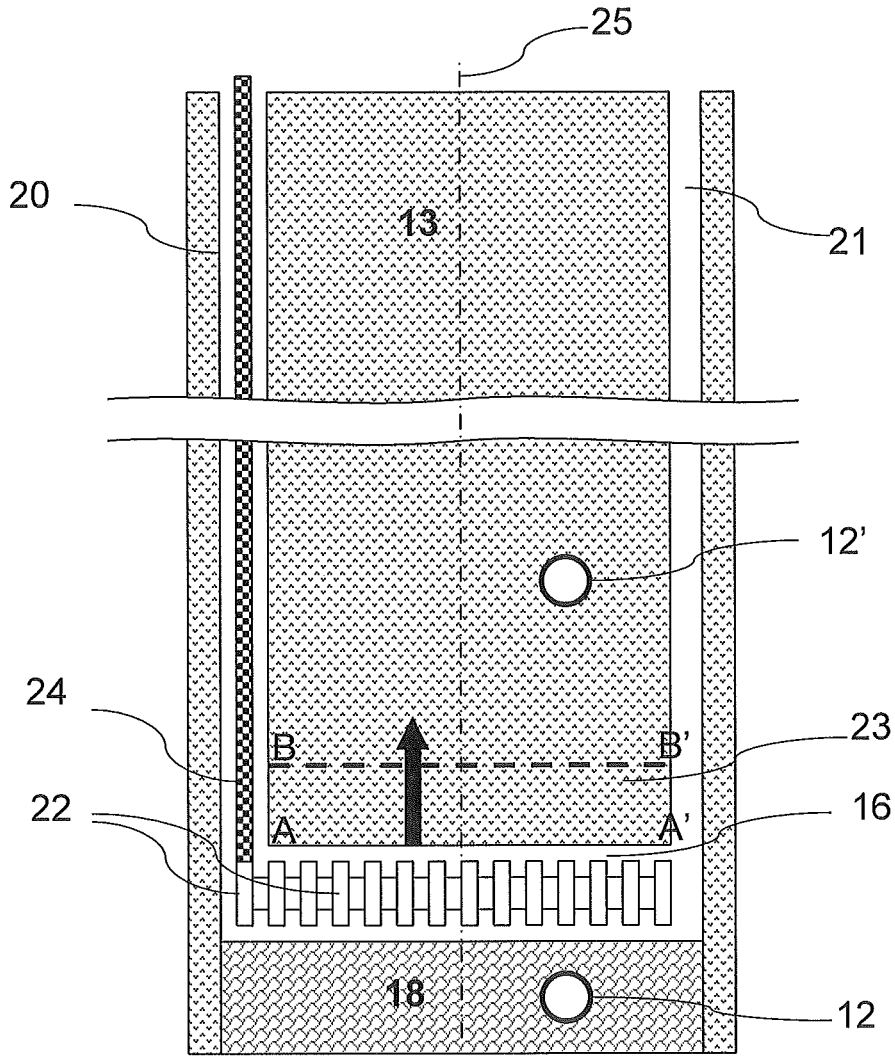
FIG. 3 illustrates a plan view of a long-wall mining system and its operation for producing non-combustible ore and methane according to a third embodiment of the present invention, wherein at least one vent well positioned above the ore bed is in fluid communication with the gob.

For example, an advantageous embodiment employing the long-wall mining of a trona bed is illustrated in FIG. 3 (plan view). Two parallel passages 20, 21 are created into an underground formation and then connected laterally by the creation of an initial cavity 16, thereby defining a trona panel 13 having, as length, about the length of the parallel passages and, as width, the length of the initial cavity 16, the working face of the trona panel 13 (shown as line AA') extending from one parallel passage 20 to the other passage 21. Such mining method further comprises supporting the roof of the initial cavity 16 by means of movable roof supports 22 and mining the exposed face AA' of the trona panel 13 under the protection of the roof supports 22. The roof supports 22 thus prevent roof caving in this initial cavity 16 while a new trona region with the working face AA' is being mined. The mining method would then comprise removing the mined trona material to form a (second or subsequent) newly mined-out cavity (shown as 23 in FIG. 3). A conveyor 24 is used to remove the mined trona away from the mining surface to be directed to the surface for further processing. As the working face recedes within the trona panel 13, the long-wall mining method would then comprise advancing the roof supports 22 into the (second) subsequent mined-out cavity 23 so that they remain essentially adjacent to a new working face (illustrated with a dashed line BB'). Due to the advance of the roof supports 22 leaving the previously supported roof of the initial cavity 16 unsupported, the pressure of the rock overburden causes caving of its unsupported roof to form the gob 18.

The long-wall mining method thus comprises incrementally repeating the mining step of the exposed face of the ore panel 13 under the protection of roof supports 22, the mined ore removal step, the advancing of roof supports 22, and the caving of unsupported roof to enlarge the gob 18.

In this embodiment using the long-wall mining technique, it is particularly preferred that two vertical wells 12, 12' are drilled from the earth's surface between the two parallel passages 20, 21 to a subterranean location above the trona panel 13. The two wells are preferably drilled offset from the axial centerline of the trona panel 13. The two wells 12, 12' are separated from each other by a distance less than the panel length, preferably a distance comprised between one third and two thirds of the length of the trona panel 13. As the long-wall working face advances, the downhole ends of the two vertical wells 12, 12' are then successively surrounded by fractured rock in the formed gob 18. As shown in FIG. 3, only one of the vertical wells (12) is surrounded by the gob 18. Since the gob 18 has not yet reached the subterranean location of the downhole end of the second vertical well 12', the gob gas is solely recovered from the first vertical gob well 12.

Another embodiment of the method may employ solution mining of a non-combustible ore bed which comprises a desired mineral solute. This solution mining method may comprise creating a lined or cased portion of a borehole from the surface down to the ore bed roof at a desired location, preferably within a down-dip region of the ore bed, and further extending the borehole with an unlined portion past the ore bed floor to form a sump in which a downhole pump is installed. The solution mining may further comprise drilling a directional unlined borehole portion to travel more horizontally, above the ore floor, within a region of the ore bed, preferably from the sump toward an up-dip region where an initial mined-out cavity is present or will be created.

The solution mining step further comprises injecting a solvent (generally water or an unsaturated solution) through the unlined borehole portion (for example by inserting into the unlined portion a concentric conduit with a solvent injection zone positioned at the conduit downhole extremity) in order to expose an ore region to the solvent and allow dissolution of desired mineral solute from the solvent-exposed ore. The dissolution thereby increases the size of the unlined borehole portion where the initial mined-out cavity (e.g., of increased cross-sectional area) is either created or increased in size if already present and connected to the downhole end of the unlined borehole portion.

The solution mining step may further comprise moving the injection point of the solvent (e.g., retracting or perforating the concentric conduit) to continue the dissolution process and to form the subsequent enlarged mined-out cavity (generally along the unlined borehole portion which is embedded in the ore bed).

Additionally or alternatively, the subsequent mined-out cavity may be created and enlarged by gravity-driven flow of solvent and dissolution of mineral solute from the ore working face.

Since the roof of the mined-out cavity is not supported, if the surrounding strata is weaker than the ore bed, gravitational energy from the overburden may 1/ cause fracture of fresh ore positioned above the mined-out cavity into rubbles and the collapse of some ore rubbles into the mined-out area; 2/ possibly cause caving and/or fracturing of overlying roof rock; and 3/ induce fracturing of at least one methane-bearing layer which can liberate methane into the caved-in region.

In such solution mining embodiment, there may be fluid communication established between the ore region being mined and the caved-in region containing rubbles, since the ore region being mined is positioned below the rock rubbles. However since mine methane gas is much lighter in density relative to mine air, mine methane stratifies in the upper zone of the caved-in area.

A well for venting methane may be placed strategically above the initial cavity (where solution mining is initiated), positioned generally in an up-dip region of the non-combustible ore. Similarly as with long-wall mining, the downhole end of the vent well does not contact the ore bed to be mined as it is positioned above the ore roof. It is the caving of the roof rock and ore located above the mined-out cavity which creates the formation of the gob and establish fluid communication between the gob and the downhole end of the vent well.

FIG. 4*a*-4*d* illustrate a solution mining system for trona and methane extraction. Such solution mining system comprises a trona bed 13 with a dip gradient, a borehole 110 (or a plurality thereof) with concentric casings and an unlined portion 115 aligned with the trona bed floor. The operation of such system has several main phases of mining: the drilling phase, the optional formation of an initial mined-out cavity 160 up-dip, and the creation of an enlarged subsequent mined-out cavity traveling down-dip with caving of overburden to form the gob 18 and resulting fracture of at least one methane-bearing layer 17 positioned above and/or below the trona bed 13.

During the drilling phase, a borehole 110 may be vertically drilled from a surface location above a down-dip region of the trona bed 13 to the ore roof with two concentric casings (an outer casing being positioned from the surface to the bed roof and an inner conduit 140 positioned inside the borehole 110) and then directionally drilled within the trona bed 13 and above its floor until the downhole end of the borehole 110 reaches an up-dip region within the trona bed 13. The downhole end of the borehole 110 preferably intercepts an initial cavity which was drilled or mined-out; or the downhole end of the borehole 110 may be the starting point for the creation of an initial cavity by solution mining as will be described later, the initial cavity being shown as 160 in FIG. 4*a-b*.

The vertical well 12 is drilled from a surface location which is generally laterally distanced within 500 feet or less from the downhole end of the borehole portion 115 which is hydraulically connected to the initial cavity 160.

In some embodiments where there is no initial mined-out cavity in the trona bed 13, the formation of the advancing mined-out cavity may be initiated by injecting a solvent (water or an aqueous solution containing sodium carbonate and/or sodium hydroxide) into the unlined portion 115 so that the trona region proximate to the downhole end of the unlined portion 115 is exposed to solvent resulting in dissolution of some of the sodium values and in creating the initial mined-out cavity 160 at and near the downhole end of the unlined portion 115. The solvent injection may be effected via the downhole extremity 150 of the inner conduit 140 positioned concentrically in the borehole 110 and its portion 115, in such a way that the downhole extremity 150 of the inner conduit 140 is close to the downhole end of borehole portion 115.

The solvent dissolves sodium values from the solvent-exposed trona to form a pregnant solution which then flows by gravity downwards through the unlined borehole portion 115 to the sump 128. As the solution flows towards the sump 128, it gets denser as it is getting enriched in sodium values by dissolving the walls of the unlined portion 115. It is preferred that as the solution reaches the sump 128, it has become saturated in sodium values and formed a liquor. The liquor collected in the sump 128 is then directed (generally pumped via sump pump 130) to the surface via a return pipe positioned inside the outer casing of borehole 110 for the liquor to be processed in a soda ash refinery.

Figure 4A:
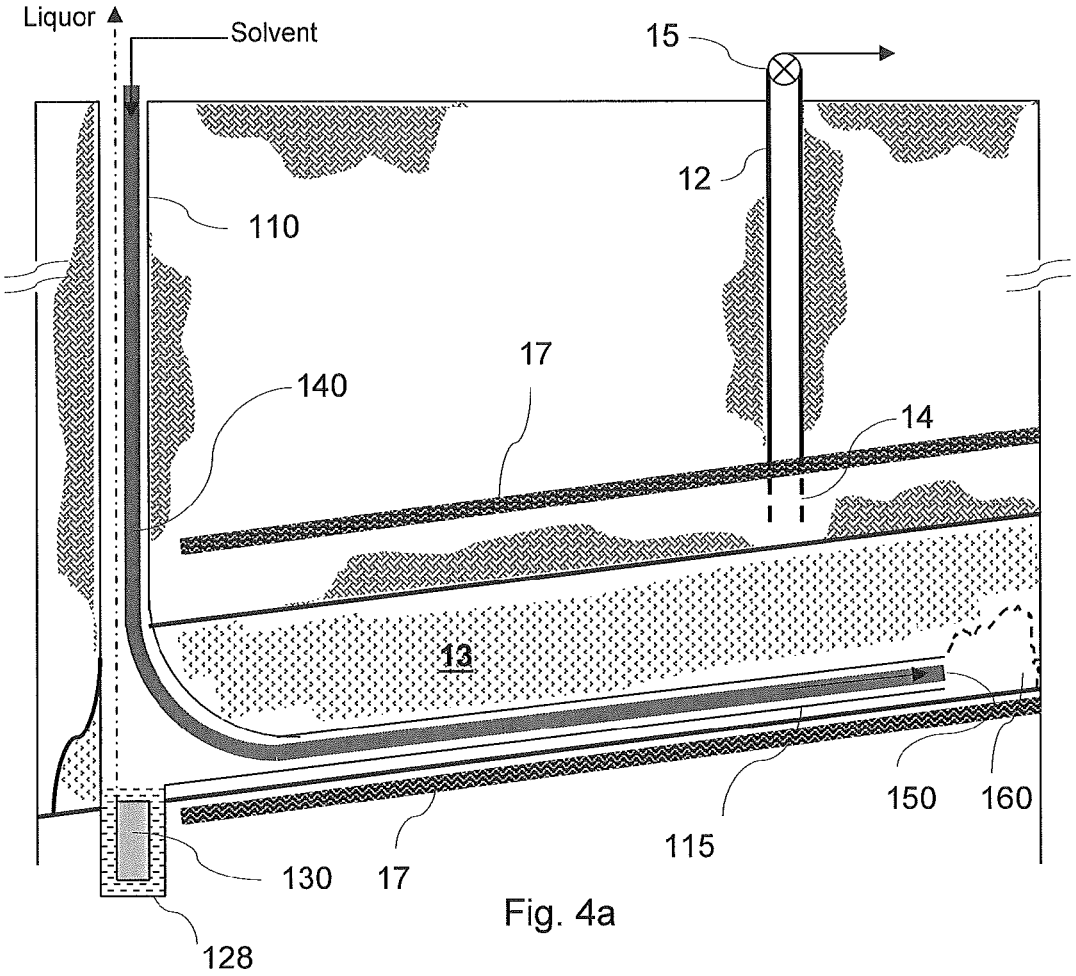
FIG. 4*a-d* illustrate a solution mining system and its operation for producing trona ore and methane according to a fourth embodiment of the present invention, wherein a gob is created by caving of a mined-out cavity and a vent well positioned above the ore bed becomes in fluid communication with the gob.
Figure 4B:
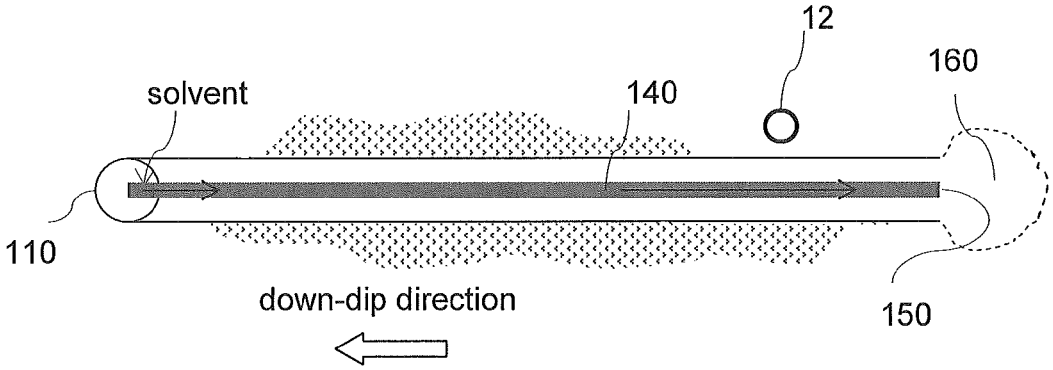
Figure 4C:
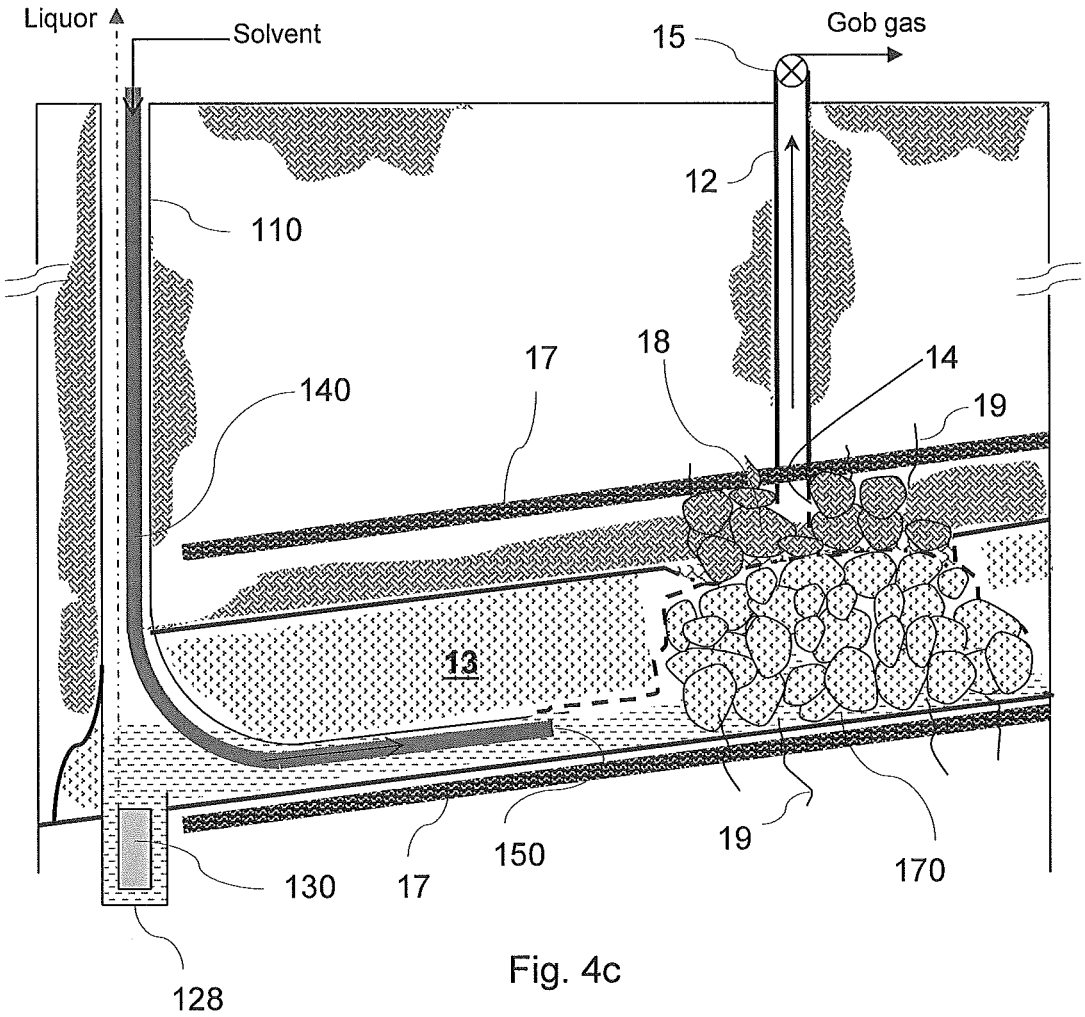
Figure 4D:
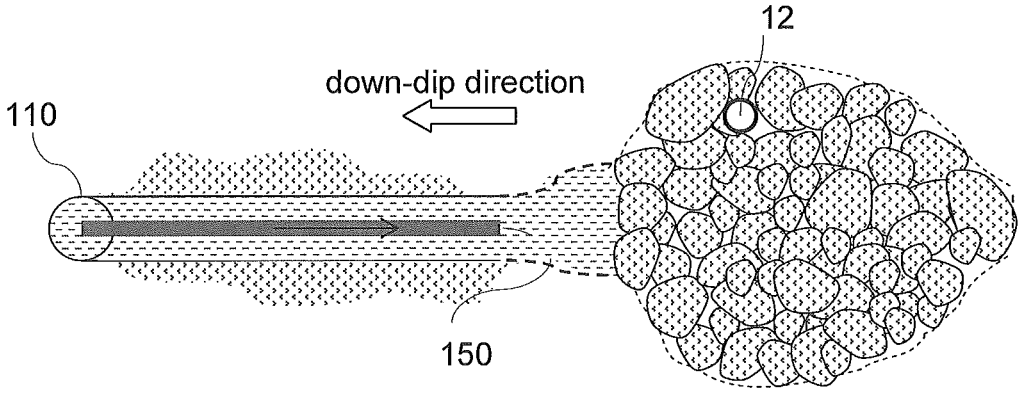

Regardless whether the initial mined-out cavity 160 is created by solution mining or by another mining method, the mining method thus continues as follows. As illustrated in FIG. 4*c* (elevation view) and FIG. 4*d* (plan view), by continual injection of solvent and collection of liquor as described above, a subsequent mined-out cavity 170 is being formed by dissolution of additional trona from solvent-exposed trona region. To advance the working face of the cavity in a down-dip direction, the concentric conduit 140 may be retracted within the unlined portion 115 of borehole 110 as shown in FIG. 14*c-d* in order for the subsequent mined-out cavity 170 to expand towards the down-dip edge of the bed 13.

Because the roof of the mined-out cavity is not supported, pressure from the overburden causes the caving of the ore and roof material above the cavity as well as the creation of fractures 19 in the methane-bearing layers 17 which may be positioned above and/or below the trona bed 13. If the roof cracks, there may be the formation of the gob 18 above the ore rubbles in the subsequent mined-out cavity 170. The fractured methane-bearing layer(s) 17 may release methane into the caved-in gob 18 positioned above the cavity 170 filled with ore rubbles. As the solution mining progresses, eventually the downhole end 14 of the well 12 may be surrounded by rock rubbles in the gob 18 (as shown in FIG. 4*c*), and fluid communication between the gob 18 and the well 12 is established.

When methane is released by fractures of layers 17, the mine methane will have a tendency to migrate upwards (being more buoyant than mine air) and be directed to the surface via the well 12, so long as there is an established fluid communication between the downhole end 14 of the well 12 and the caved-in region (including gob 18). The methane extraction from the gob 18 may be performed periodically or continuously. Periodical purges of the gob gas comprising methane may be preferred, and the solvent flow would be momentarily interrupted during the periodic gob gas purges. A methane-powered pump or exhauster 15 may be used to facilitate the flow of gob gas through the well 12.

The solution mining operation is considered complete once the concentric conduit 140 is pulled all the way to the down-dip end of the unlined portion 115 of borehole 110. The solvent injection through the conduit 140 is generally terminated when the mined-out cavity is completely filled with rock rubbles, and where trona rubbles exposed to solvent have dissolved away leaving behind insolubles at the floor of the dissolved trona bed.

Regardless of which mining technique is used in the method of the present invention, very surprisingly, the recovered gob gas which comprises the released mine methane can have a very high methane content. Since methane has a specific gravity relative to air of 0.55, methane rises to the highest level in the gob. When the downhole end of the vent well becomes substantially in fluid communication with the gob, methane gas preferentially rises up into the vent well and, by stratification, the recovered gob gas exhausted by the methane-powered pump or exhauster can have a high methane concentration. Peak gas production and/or the highest quality generally may occur when the gob well is initially undermined or intercepted by mining, and then may decrease as the working face advances beyond the gob well.

Gob gas quality may range from nearly 100% methane to as low as 25% methane. In some embodiments, the recovered gob gas may comprise at least 30% methane, or at least 50% methane. In preferred embodiments, the recovered gob gas may have a concentration of at least 70% methane, more preferably at least 80% methane, most preferably at least 90% methane. In additional or alternate preferred embodiments, the recovered gob gas may comprise at most 98% methane. In some embodiments, the gob gas may comprise any methane content between 25% and 98%, or between 70% and 98%.

Since the gob gas quality is generally at least 25% in methane content, there is generally no need to enrich the gob gas in methane.

The gas flow output from the gob well may be at least about 5,660 $m^3$/day (or 200,000 $ft^3$/day) when the gob gas flow is facilitated by a pump or exhauster. With the use of a pump or exhauster, the gob gas flow output may be as high as about 85,000 $m^3$/day (or as high as 3,000,000 $ft^3$/day), or even higher. The gob gas flow rate may decrease over time as the lateral distance between the working face of the ore bed and the gob well gets longer as the mining advances.

In addition to methane, the recovered gob gas may further comprise nitrogen, (diatomic) oxygen, nitrogen-containing compounds, ethane, propane, butane, other non-methane hydrocarbons, water, ammonia, carbon dioxide, or any mixtures thereof.

The invention can advantageously provide a source of energy for the surface facility which processes the mined non-combustible ore in order to extract the desired mineral, such as processing mined trona in a soda ash refinery. It is recommended that at least a part of the recovered methane be directed to the ore processing facility or refinery to be used as fuel for the operation of one or more pieces of equipment used in the processing facility. Examples of use may be heat generation by combustion and/or electricity generation by turbines.

In the case of trona mining according to the invention, mined trona is preferably calcined in one or more calciners fueled by at least a portion of the recovered methane. Calciners require heat generation, which can be provided by burning (combusting) at least a portion of the recovered gob gas (comprising mine methane) in a furnace. For the purpose of gob gas use as a fuel, the lower content in methane of the recovered gob gas compared to commercial-grade natural gas is not an issue. As such, the recovered gob gas containing the mine methane can replace an equivalent energy content of a certain quantity of natural gas that would otherwise need to be purchased. It is estimated for example that up to 25% of the total natural gas consumption as fuel can be provided to a soda ash refinery by the mine methane collected in the gob gas.

The invention further allows the reduction of "Greenhouse Gas" (GHG) emissions by converting previously unrecoverable methane emissions into carbon dioxide by combustion.

In the case of trona mining according to the invention, the recovered methane may be combusted in a flare (also termed flared) or preferably may be used as an energy source in the soda ash refinery. It has been determined that methane is 21 times more potent than carbon dioxide as a GHG. Thus, conversion of previously unrecoverable mine methane to carbon dioxide by combustion (e.g., burning in the soda ash refinery and/or flaring) will reduce GHG emissions by a factor of 18.25 tons of carbon dioxide equivalent per ton of mine methane, after accounting for the GHG contribution of carbon dioxide produced by combusting the mine methane.

With respect to total operational costs and capital investments, the cost of drilling wells and purchasing vacuum pumps or exhausters is offset by cost savings realized in utilizing a substantial amount of the mine methane recovered in the gob gas, so long as the methane content of the gob gas is at least 25%. When the long-wall mining technique is used for trona mining for example, it has been observed that the recovery of methane is effective even when the long-wall working face is more than 1.6 kilometers away from the gob well.

An unforeseen benefit of the invention with respect to trona mining is that, in addition to reducing methane in the mine ventilation system and therefore reducing a potential hazard to the mining system and miners, the recovered gob gas comprising methane is of sufficient quality and quantity for use as fuel in the soda ash refinery. For instance, the long-wall trona mining process as described previously and also used in the following Examples has the particular capability of liberating methane from shale layers above and/or below the trona bed through caving and fracturing of the gas-bearing strata to an extent that cannot be duplicated by other means from the surface. Venting this gas through the gob well bore during mining then reduces the amount of methane that must be diluted in the mine return airways. A portion of the methane that normally would have been released to atmosphere through the mine's exhaust ventilation shaft as ventilation air methane at 0.3 to 0.4% methane, can be collected and transported to the soda ash refinery to replace a significant portion of the purchased natural gas. If the gob gas containing mine methane is not used or only used in part for example as a fuel in the soda ash refinery, the entirety of the recovered gob gas containing mine methane or its unused remainder can be flared to decrease greenhouse gas emissions.

EXAMPLES

The following examples, illustrated by FIG. 1-3, describe some preferred embodiments of the invention.

Example 1

Figure 5:
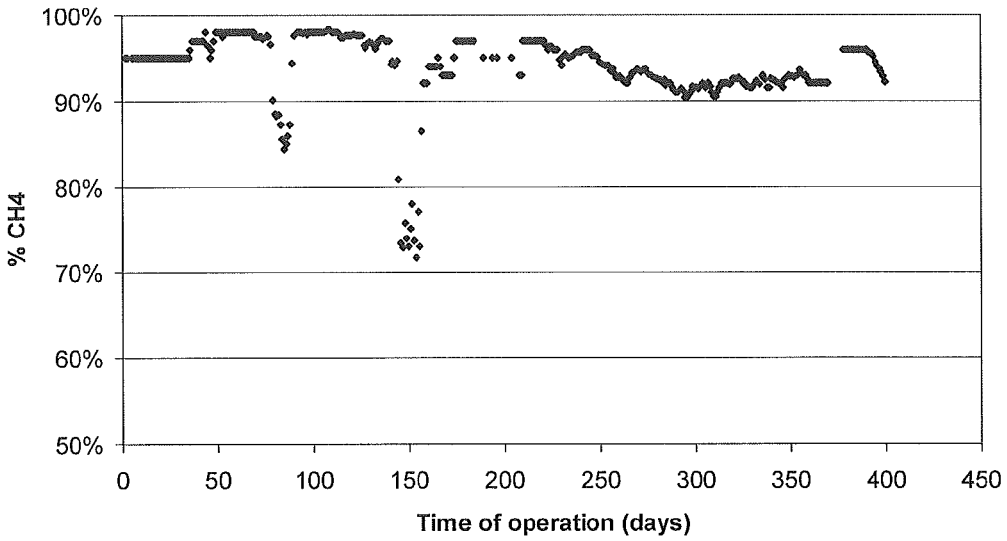
FIG. 5 plots the content of methane in a gob gas recovered from the long-wall mining of a trona panel as a function of time according to one embodiment of the present invention.

Methane was recovered from the gob 18 of the operating underground long-wall trona mining system as illustrated in FIGS. 1 and 2. This was accomplished with the use of a vertical well, also known as gob vent bore (GVB), shown as 12 on FIG. 1 drilled from the surface to a depth just above a 2.7-km long long-wall trona panel shown as 13 on FIG. 1. The surface location of the vertical well 12 was offset from the axial centerline 25 of the trona panel 13 (as illustrated in the plan view in FIG. 3). The vertical gob vent bore 12 was drilled in advance of the long-wall face. The GVB 12 consisted of a cased wellbore drilled with a rubber-tired mounted drill rig 11 to a depth approximately 75 m (about 250 feet) above the roof of the trona panel 13. After a solid steel casing was cemented in place, the well was drilled to approximately 6 meters (about 20 feet) to a location above the roof of the trona panel 13. A slotted or perforated casing, shown as 14 in FIG. 1, was then lowered at the bottom of the well. The slotted casing 14 extended from the bottom of the cemented casing to the downhole end of the well. Once the drilling of the GVB was complete, a methane extraction pumping system shown as 15 in FIG. 2 was installed on the surface. The pumping system 15 included piping, valves, flame arrestors, and a methane-powered engine driving a vacuum pump. As the long-wall mined-out cavity 16 advanced past the downhole end of the GVB 12 as shown in FIG. 2, mine methane was released from the oil shale layers 17 above and below the trona layer by the caving action of the long-wall mining system. The caving action generated fractures 19 in the rock layers above and below the caved zone which liberated mine methane. Once mine methane became available to the GVB 12, the vacuum pumping system 15 was started to pump a gob gas containing released mine methane to the surface. The extracted gob gas could be vented to atmosphere, flared, or collected and directed (e.g., transported via pipe line) to the soda ash refinery and used (at least in part) as a fuel in the refinery for soda ash production. A daily average quantity of about 34,000 cubic meters ($m^3$/day) of methane gob gas (or about 1,200,000 cubic feet/day) was recovered. The gob gas on average contained 94% methane, 4% nitrogen, 0.9% ethane, 0.4% oxygen, 0.4% propane and 0.1% butane. However, over the course of over 6 months in operation of the GVB, the daily volumetric flow rate of gob gas ranged generally from 11,300 to 46,750 $m^3$/day (or about from 400,000 to 1,650,000 cubic feet/day), the highest volumetric flows being realized in the initial mining phase. Similarly, the methane content in the gob gas ranged generally from 82% to 97%, with short incursions between 75% and 85%, as shown in FIG. 5. It should be noted that since the gob gas flow is dependent on the size and speed of the vacuum pump in place, larger flow rates of gob gas may be achieved.

Figure 6:
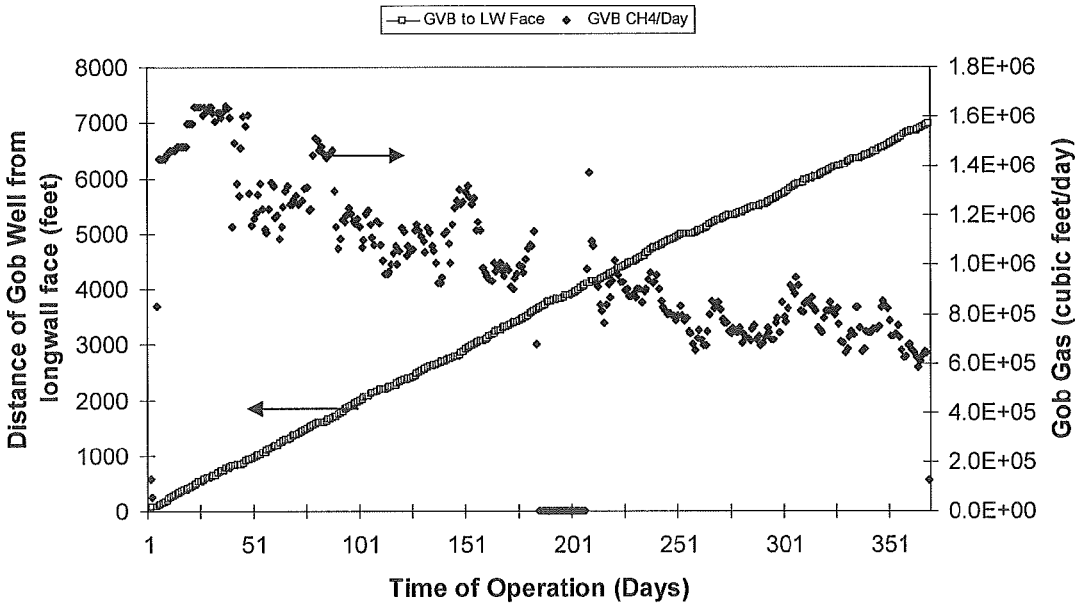
FIG. 6 plots the daily volumetric flow rate of a gob gas recovered from the long-wall mining of a trona panel as a function of the distance between the vent well and the long-wall mining face during the mining operation according to one embodiment of the present invention.

As illustrated in FIG. 6, it was observed that the daily volumetric flow rate of gob gas decreased as the distance between the GVB and the long-wall mining face increased during the mining operation and reached its maximum distance of 2,200 meters (or 7,200 feet) at the completion of the long-wall panel.

Example 2

As in Example 1, a second GVB well (for example as shown as well 12' in FIG. 3) can be drilled at a distance of 1360 meters (or about 4500 ft) from the first GVB 12, also from a surface location which is offset from the axial centerline 25 of the 2.7 km trona panel 13.

The first GVB 12 in the panel continues to produce mine methane as the long-wall face advances toward the second GVB 12'. When the long-wall face advances under the second GVB 12', a second methane extraction pumping system similar to the system 15 shown in FIG. 2 is started to produce additional methane. Both pumping systems continue to produce mine methane as the long-wall face advances. Both pumping systems can be operated as long as mine methane is available. The process can then be repeated in an adjacent long-wall panel.

Accordingly, the scope of protection is not limited by the description and the Examples set out above, but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention.

While preferred embodiments of this invention have been shown and described, modifications thereof can be made by one skilled in the art without departing from the spirit or teaching of this invention. The embodiments described herein are exemplary only and are not limiting. Many variations and modifications of systems and methods are possible and are within the scope of the invention.

The invention claimed is:

1. A mining method for co-producing non-combustible ore and methane from an underground formation, said underground formation comprising at least one methane-bearing layer and an ore bed to be mined comprising non-combustible ore and having a roof above which rock material is present, the method comprising:

drilling a least one well from the earth's surface towards the ore bed, said well having a downhole end positioned above the ore bed roof, said downhole end of the well not being in contact with the ore bed to be mined;

providing at least an initial cavity into the formation, the initial cavity giving access to an initial working face of the ore bed to be mined;

mining an ore region from the initial working face and removing the mined ore, thereby creating a subsequent mined-out cavity with a new subsequent working face;

advancing the mining step to another ore region from the subsequent working face;

allowing the roof of the initial cavity to cave so as to create a gob containing at least rock rubbles;

repeating the mining, advancing and caving steps, in a manner effective to cause fracture of the methane-bearing layer and release of mine methane into the gob, and to further establish fluid communication between the gob and the downhole end of the well;

recovering a gob gas comprising between 25% and 98% methane through the well to the surface; and combusting at least a portion of said recovered gob gas comprising said methane in a flare or in a surface refinery where the mined ore is processed.

2. The method according to claim 1 wherein the downhole end of the well is situated at least 3 meters above the roof of the ore bed.

3. The method according to claim 1 wherein the at least one well is a vertical well, and wherein the downhole end of the vertical well comprises a slotted casing.

4. The method according to claim 3 wherein the slotted casing in the well downhole end has a length of between 30 and 100 meters.

5. The method according to claim 1 wherein any cavity which provides a working face to be mined is provided with roof supports, and wherein the supports are incrementally advanced into any subsequent mined-out cavity.

6. The method according to claim 1 wherein the mining step comprises long-wall mining.

7. The method according to claim 6 wherein the initial cavity is an initial horizontal mined-out cavity, wherein two substantially parallel passages are created into the underground formation, connected by the initial horizontal mined-out cavity, thereby defining an ore panel having the length of the parallel passages, the initial working face of the initial horizontal mined-out cavity extending from one parallel passage to the other, and wherein two wells are drilled offset from the axial centerline of the ore panel from a surface location located between the two parallel passages.

8. The method according to claim 7 wherein the two wells are separated from each other by a distance comprised between one third and two thirds of the length of the passages.

9. The method according to claim 1 wherein at least a portion of the recovered gob gas comprising released methane is directed to the surface refinery where the mined ore is processed, so that at least a portion of said recovered gob gas comprising released methane is used as an energy source in the ore processing refinery.

10. The method according to claim 1 wherein at least one methane-bearing layer is positioned above the non-combustible ore bed.

11. The method according to claim 1 wherein at least one methane-bearing layer is positioned below the non-combustible ore bed.

12. The method according to claim 1 wherein the non-combustible ore comprises trona.

13. The method according to claim 12 wherein the mined trona is calcined in a calciner fueled by at least a portion of the recovered gob gas comprising released methane.

14. A method for reducing the green house effect during mining of a non-combustible ore with co-production of mine methane from an underground formation, said method comprising carrying out the mining method according to claim 1, wherein said underground formation comprising at least one methane-bearing layer and a non-combustible ore bed comprising trona, and wherein at least a portion of the mine methane is recovered from the gob via the well and combusted.

15. The method according to claim 1 wherein a tubular casing is placed in an upper part of the well after its drilling to ensure smooth flow of the gob gas, wherein the downhole end of the well comprises a slotted casing, and wherein the slotted casing of the well downhole end is moveable, is not fixed to the casing of the well upper part, and is positioned free-standing at the bottom of the well to allow relative movement of the slotted casing with respect to the well upper part.

16. The method according to claim 1 wherein the downhole part of the well passes through an overlying methane-bearing layer.

17. The method according to claim 1 wherein the downhole end of the well is positioned at an intermediate depth between an overlying methane-bearing layer and the roof of the ore bed being mined.

18. The method according to claim 1 wherein the gob gas flow is facilitated by a pump or exhauster, and wherein the gob gas flow output from the well is at least about 200,000 $ft^3$/day.

19. The method according to claim 18 wherein at least a portion of the recovered gob gas comprising released methane is directed to a surface refinery where the mined ore is processed, so that at least a portion of said recovered gob gas comprising released methane is used as an energy source in the ore processing refinery.

20. The method according to claim 1 wherein the gob gas flow is facilitated by a methane-powered engine vacuum pump or exhauster, and wherein a methane-powered engine coupled to the vacuum pump or exhauster is powered by at least a portion of the released methane.

21. A mining method for co-producing non-combustible ore and methane from an underground formation, said underground formation comprising at least one methane-bearing layer and an ore bed to be mined comprising non-combustible ore and having a roof above which rock material is present, the method comprising:

drilling a least one well from the earth's surface towards the ore bed, said well having a downhole end positioned above the ore bed roof, said downhole end of the well not being in contact with the ore bed to be mined;

providing at least an initial cavity into the formation, the initial cavity giving access to an initial working face of the ore bed to be mined;

solution mining an ore region from the initial working face, said solution mining step comprising:

injecting a solvent into the initial cavity to expose the initial working face in a manner effective to dissolve a desired mineral solute from the exposed ore, and to form a liquor comprising dissolved desired mineral solute, said dissolution being effective in forming a subsequent mined-out cavity and in advancing the initial working face to a subsequent working face, repeating the solvent injection and dissolution in a manner effective to enlarge the subsequent mined-out cavity by dissolving more of the desired mineral solute from the subsequent working face of the solvent-exposed ore, and removing the mined ore by flowing the liquor to the surface;

allowing the caving of overburden ore and rock nibbles into the initial and subsequent mined-out cavities to form a gob and to fracture the at least one methane-bearing layer to release methane into the gob, and to further establish fluid communication between the gob and the downhole end of the well; and recovering a gob gas comprising released methane through the well to the surface.

* * * * *